United States Patent [19]

Karlsson et al.

[11] Patent Number: 4,983,129

[45] Date of Patent: Jan. 8, 1991

[54] CONTACT MEMBER

[75] Inventors: Karl O. Karlsson, Hägersten; Alf T. Westerlund, Örnsköldsvik; Gunnar S. Fransson, Enskede, all of Sweden

[73] Assignee: Telefonaktiebolaget L M Ericsson, Stockholm, Sweden

[21] Appl. No.: 458,627

[22] PCT Filed: Apr. 5, 1989

[86] PCT No.: PCT/SE89/00175

§ 371 Date: Jan. 16, 1990

§ 102(e) Date: Jan. 16, 1990

[87] PCT Pub. No.: WO89/12335

PCT Pub. Date: Dec. 14, 1989

[30] Foreign Application Priority Data

Jun. 1, 1988 [SE] Sweden ..... 8802043

[51] Int. Cl.[5] ..... H01R 4/24

[52] U.S. Cl. ..... 439/395; 29/566.1; 439/391

[58] Field of Search ..... 439/391–407; 29/33 M, 566, 566.1, 566.2, 566.3, 566.4

[56] References Cited

U.S. PATENT DOCUMENTS

Re. 32,898 4/1989 Dechelette ..... 439/395

3,636,500 1/1972 Sedlacek ..... 439/395

4,671,595 6/1987 Pohl ..... 439/399

FOREIGN PATENT DOCUMENTS 2019118 10/1979 United Kingdom ..... 439/391

*Primary Examiner*—David L. Pirlot

*Attorney, Agent, or Firm*—Burns, Doane, Swecker & Mathis

[57] ABSTRACT

The present invention relates to a contact member (1) with a bifurcated part (2) which is formed with two legs (**3*a*, 3*b*) and an intermediate slit (4) and is intended, on being transversely thrust against an insulated conductor, to penetrate the insulation and make electrical contact with the conductor. The bifurcated part (2) is stamped at the contact region (5) such that the material in the legs (3*a*, 3*b*) parallel to the plastically deformed towards the slit so that the latter is given correct width and tolerance in relation to the conductor. In accordance with the invention, the material in the legs is deformed (6*a*, 6*b*) so that the side surfaces of the slit are mutually parallel and have greater height in the thickness direction of the member (1**) than the rest of the member.

The invention also relates to a tool containing two counter-acting punches (10) for stamping out a contact member (1) in accordance with the invention.

6 Claims, 5 Drawing Sheets

CONTACT MEMBER

TECHNICAL FIELD

The present invention relates to a contact member, more specifically to a contact member with a bifurcated part comprising two legs and an intermediate slit, and disposed such that on transversal thrusting against an insulated conductor it penetrates the insulation and makes electrical contact with the conductor. The invention also relates to a tool for stamping a contact member in accordance with the invention.

BACKGROUND ART

Contact members with a bifurcated part formed such that on thrusting transversely against an insulated conductor they penetrate the insulation and make electrical contact with the conductor, so-called slit contact tips, are already known and are used in different connections for connecting conductors with each other in terminal boxes or for connecting conductors with electrical components in circuit boards or the like.

Contact members of the kind mentioned above are stamped out from a flat blank and a slit is stamped in the member. Since it is not possible to stamp out narrower slits at about 0.6 mm, because the punch will break when it is used in production, the slit obtained is still too wide to give sure contact against wires with a conductor diameter of 0.4–0.7 mm. To remedy this, and to obtain a narrow slit such that the contact member cuts through the insulation and gives a gas-tight contact with the conductor, the material lying parallel to the slit in the contact region is stamped. The stamped impression is done with a punch which plastically deforms the edges of the slit towards each other. Above the slit the punch has a shallow upside-down V profile, which is defined by flat or somewhat outwardly curved surfaces substantially parallel to the working direction of the punch. The punch works against a flat die. For reliably controlling the slit width, there have also been attempts to use a die with a tongue that thrusts into the slit. Since the tongue is too small it is easily broken, however.

DISCLOSURE OF THE INVENTION

In manufacturing a contact member by stamping in the way given above, there will be problems in obtaining the required width and tolerance of the slit when the starting material varies in hardness and thickness. Since the member is only impressed from one side, the material is also only deformed on one side, resulting in that the slit becomes wedge-shaped, i.e. its edges on the impression side are closer to each other than on the opposing side. The contact surface against a conductor will thus be less than what is theoretically possible. All this means that the slit contact tips are given an uneven quality, and in certain extreme cases a gas-tight contact is not obtained.

One object of the present invention is to provide a contact member which does not have the above-mentioned disadvantages, by stamping the member in the region of contact such that the material at the edges of the slit deform plastically so that the right width and tolerance are obtained, and so that the side surfaces of the slit are parallel and have greater height in the thickness direction of the member than in the rest of the member.

Preferably, one leg of the member is stamped from one side and the other leg of the member from the other side.

Another object of the present invention is to provide a tool for stamping the contact region of the member such that the tool contains two punches, a first and a second punch working against each other, each of which has a projecting profile along the slit and a surface sloping in the transverse direction of the slit, this surface being defined by two parallel, flat surfaces in the working direction of the punch, a first of these surfaces together with the sloping surface forming an acute angle above one leg, in the case of the first punch, such as to plastically deform the material in the leg towards the slit during stamping, and of which the second flat surface together with a contiguous flat surface at right angles to the second flat surface forms a die towards the material in the other leg which is plastically deformed by the second punch, the distance between the second flat surfaces of the punch profiles, measured in the transverse direction of the slit, corresponding to the desired width of the slit.

A groove is preferably formed between the second flat surface of each punch profile and the contiguous flat surface, this groove being formed by an extension of the second flat surface and a surface sloping towards the contiguous flat surface.

Implementing a contact member in accordance with the invention signifies several advantages.

An important advantage with the contact member in accordance with the invention compared with previously known such members is that a conductor which is thrust into the slit is given secure electrical contact with the member, since the width of the slit can be stamped to lie within well defined tolerances in relation to the diameter of the conductor. It is here a particular advantage that the side surfaces of the slit are parallel and have greater height than the rest of the contact member, so that a large contact surface is obtained between the member and conductor. Since the side surfaces are mutually parallel, moisture cannot penetrate between the member and conductor to cause corrosion, and gas-tight contact is obtained.

The tool in accordance with the invention has been found to function very satisfactorily for punching contact members, so that the member is deformed plastically such that the slit is given the required width and tolerance. Since the tool includes two counter-operating punches, no separate die is required, a part of each punch being utilised for this purpose.

The invention will now be described in more detail with the aid of a preferred embodiment and with reference to the accompanying drawings.

BEST MODE FOR CARRYING OUT THE INVENTION

Figure 1:
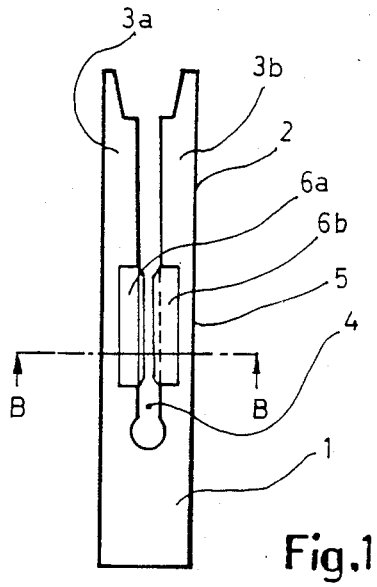
FIG. 1 is an enlarged view from above of a contact member in accordance with the invention.
Figure 2:
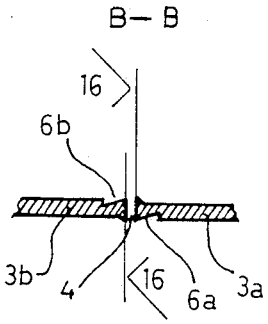
FIG. 2 is a section of the contact member according to FIG. 1.
Figure 3:
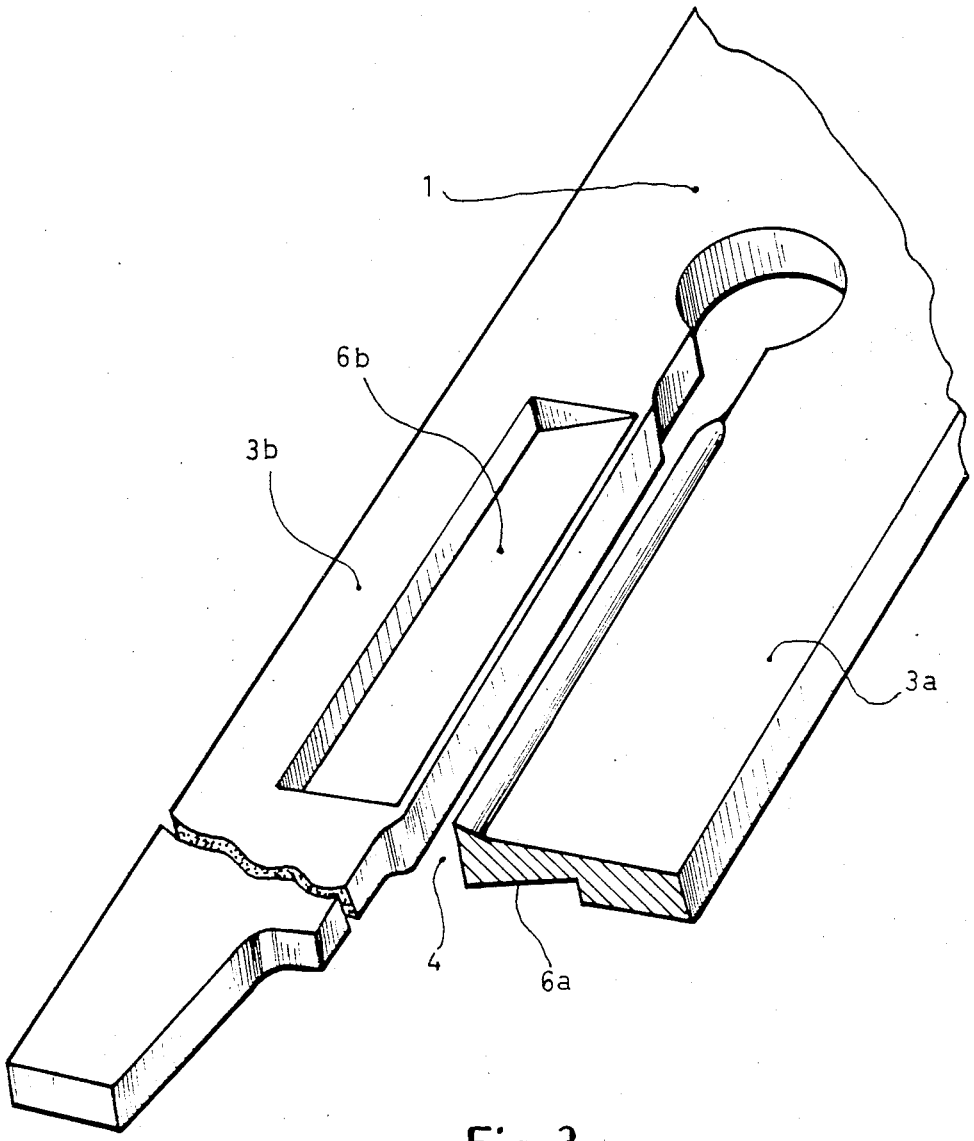
FIG. 3 is a perspective and partially sectioned view of the member according to FIG. 1.

A preferred embodiment of the contact member in accordance with the invention is shown in FIGS. 1–3. The member 1 is a so-called slit contact tip and has a bifurcated part 2 comprising two legs 3a and 3b with an intermediate slit 4. The slit 4 extends in a first direction (vertically in FIG. 1) between the legs 3a, 3b. The bifurcated part 2 is formed such that when an insulated conductor is thrust transversely into it the insulation is penetrated and electrical contact is made with the conductor. The conductor is thrust into the slit 4 and into a contact region 5.

The slit 4 is stamped out in the contact member 1. As mentioned above, it is not possible to stamp a slit which is sufficiently narrow for the member to make sure contact with a slender conductor. For avoiding this problem the member 1 is stamped in the contact region 5 such that the material in the legs 3a and 3b is plastically deformed inwardly towards the slit 4. In this way the width of the slit 4 can be obtained such that it lies within correct tolerances with relation to the conductor dimension. In accordance with the invention, the stamping is carried out such that one leg 3a is stamped from one side of the member in the area 6a, while the other leg 3b is stamped from the other side of the member in the area 6b. As is most clear from FIG. 3, the stampings 6a and 6b are executed so that the material in the legs 3a and 3b is impressed in the areas 6a and 6b and is deformed plastically towards the slit 4. The side surfaces of the slit 4 are mutually parallel, and, as seen in FIG. 2, are thicker than the legs 3a, 3b in a second direction (vertically in FIG. 2) which is generally perpendicular to the first direction in which the slit 4 extends.

Figure 4:
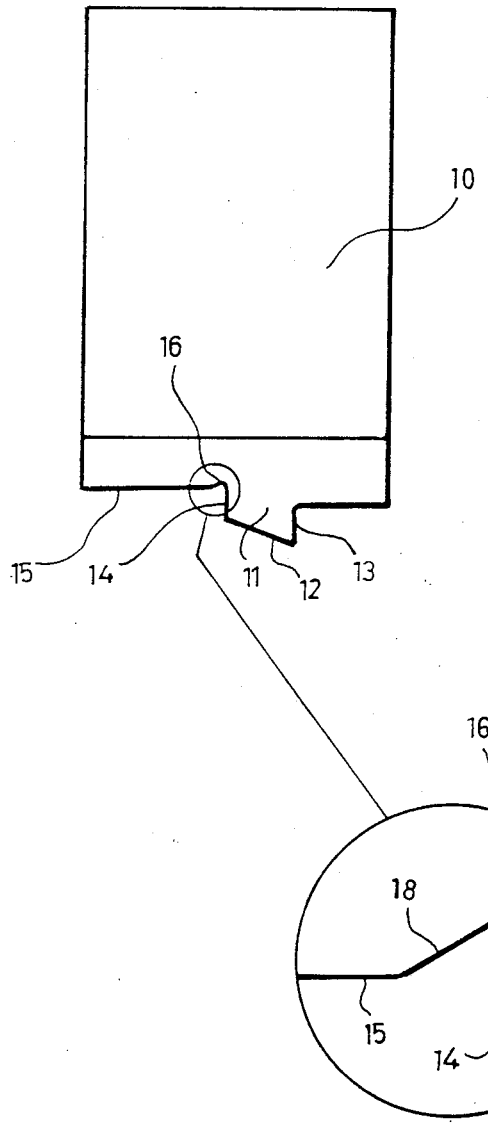
FIG. 4 is an enlarged view from one side of a punch in accordance with the invention for working on a contact member according to FIG. 1, FIG. 5 schematically illustrates the stamping operation for a contact member according to FIG. 1, using two counter-operating punches according to FIG. 4.

In FIG. 4 there is shown a tool for making the impressions 6a and 6b in the member 1. The tool includes two identical punches 10, each of which includes a projecting profile 11 along the slit 4, with a sloping surface 12 transverse the slit. The surface 12 is defined by two parallel flat surfaces 13 and 14 situated in the working direction of the punch.

The sloping surface 12 and the flat surface 13 together form an acute angle, intended, when the punch is in operation, to lie above one leg 3a (or 3b) and plastically deform the material in this leg towards the slit 4. The second flat surface 14 forms together with a contiguous flat surface 15 a die for the material which is to be plastically deformed in the other leg 3b (or 3a) by a second counter-acting punch 10. Preferably, there is a groove 16 formed between the surfaces 14 and 15. The groove 16 is formed by an extension 17 of the flat surface 14 and a surface 18 inclined towards the flat surface 15. The intention with the groove 16 is that the material will be able to be deformed into it so that the side surfaces of the slit are given greater height than would otherwise be possible.

Figure 5:
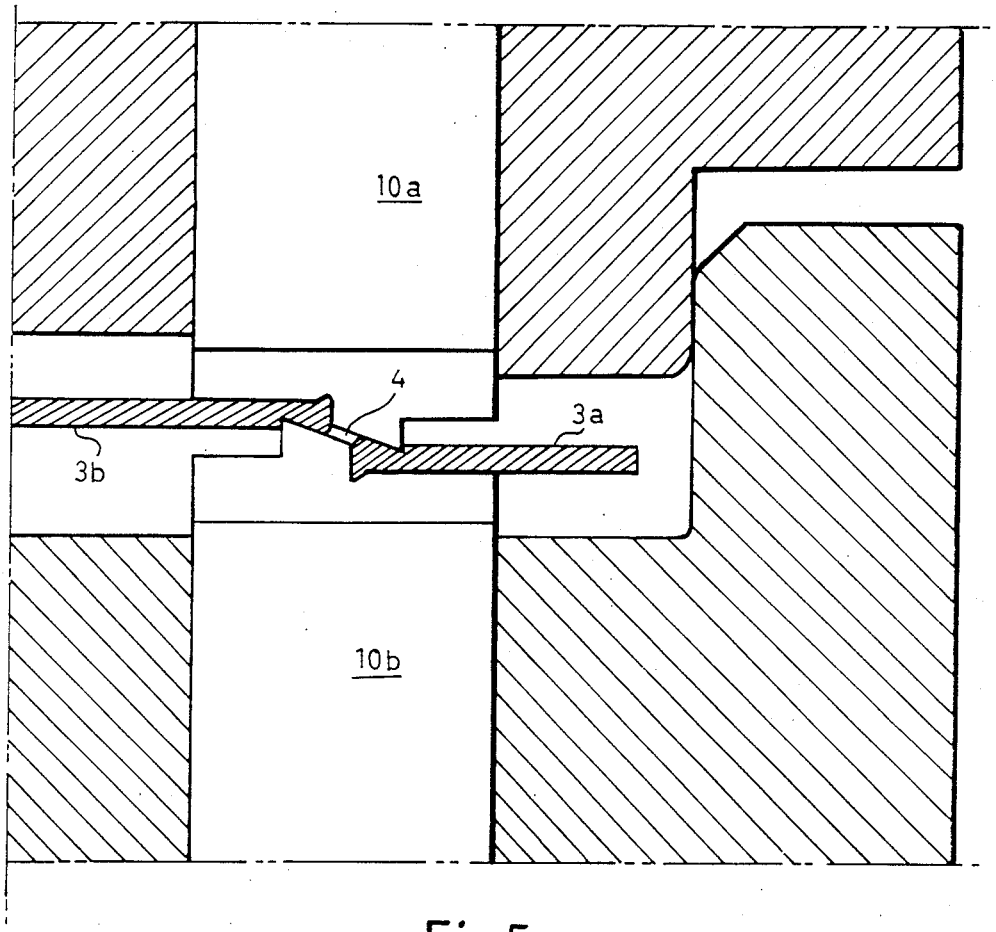
Figure 6:
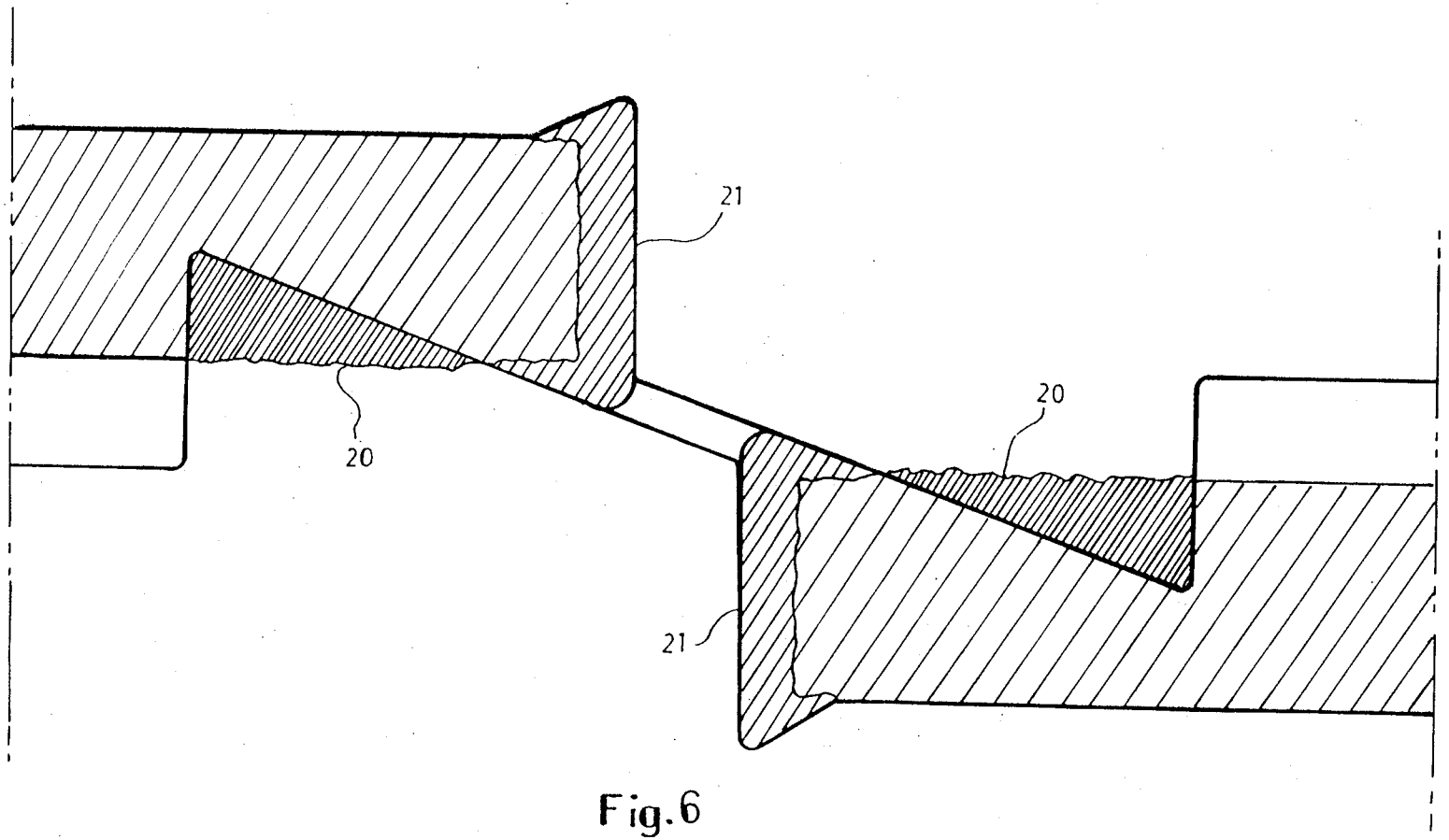
FIG. 6 illustrates even more enlarged how the contact member is deformed during the stamping operation.

The stamping operation will now be explained with reference to FIGS. 5 and 6. Two counter-acting punches 10a and 10b are arranged as illustrated in FIG. 5, and the legs 3a and 3b of a contact member 1 are placed between the punches. The distance between the respective flat surfaces 14 of the punches 10a and 10b in the transverse direction of the member correspond to the desired width of the slit in the contact region. For counteracting any possible lateral deflection of the punches during stamping, due to the deformation forces which occur, these are each arranged with neck supports which mutually engage and stiffen the punches. The deformation taking place during stamping is shown more clearly in FIG. 6. The material in each leg 3a and 3b is impressed in the area 20 and deformed towards the slit such as to fill the region 21, the flat surfaces 14 and 15 functioning as dies during the deformation. As is clearly apparent from FIG. 6, the groove 16 is also filled out by the deformed material, so that the side surfaces of the slit are given greater height than the rest of the contact member. The contact surface between the member and a conductor is thus substantially increased.

The invention is naturally not restricted to the embodiment described above and illustrated on the drawings, and can be modified within the scope of the accompanying claims.

We claim:

1. A contact member, comprising a bifurcated part including two legs, and an intermediate slit extending in a first direction between said legs, said bifurcated part for being thrust transversely onto an insulated conductor to penetrate the insulation and make electrical contact with the conductor, said bifurcated part being stamped at a contact region for contacting the conductor such that a material of said legs is deformed plastically towards said slit so that said slit is given correct width and tolerance in relation to the conductor, wherein said material in said legs is deformed such that side surfaces of said slit are mutually parallel and are thicker than said legs in a second direction which is generally perpendicular to said first direction.

2. A contact member as claimed in claim 1, wherein said legs are each deformed such that said material along said slit thrusts outside two sides of said member.

3. A contact member comprising a bifurcated part including two legs, and an intermediate slit extending between said legs, said bifurcated part for being thrust transversely onto an insulated conductor to penetrate the insulation and make electrical contact with the conductor, said bifurcated part being stamped at a contact region for contacting the conductor such that a material of said legs is deformed plastically towards said slit so that said slit is given correct width and tolerance in relation to the conductor, wherein said material in said legs is deformed such that side surfaces of said slit are mutually parallel and have greater height, in a thickness direction of said member, than the rest of said member, wherein one leg of said member is impressed from one side and the other leg is impressed from the other side.

4. A contact member as claimed in claim 3, wherein said legs are each deformed such that said material along said slit thrusts outside two sides of said member.

5. A tool for stamping a contact member which includes a bifurcated part including two legs, and an intermediate slit extending between said legs, said bifurcated part for being thrust transversely onto an insulated conductor to penetrate the insulation and make electrical contact with the conductor, said bifurcated part being stamped at a contact region for contacting the conductor such that a material of said legs is deformed plastically towards said slit so that said slit is given correct width and tolerance in relation to the conductor, wherein said material in said legs is deformed such that side surfaces of said slit are mutually parallel and have greater height, in a thickness direction of said member, than the rest of said member, wherein said tool includes two counter-acting punches, each of said punches having a projecting profile along said slit, and a surface sloping in a transverse direction of said slit, said surface being defined by flat surfaces which are parallel to a working direction of said punch, one flat surface together with said sloping surface forming an acute angle above one of said sloping surface forming an acute angle above one of said legs such as to plastically deform said material in said one leg towards said slit during stamping, and each of said punches having a second flat surface together with a contiguous flat surface which is at right angles to said second flat surface, which forms a die for the material in an other of said legs plastically deformed by a punch, a distance, at right angles to said slit between said second flat surfaces, corresponding to a desired width of said slit.

6. A tool as claimed in claim 5, wherein a groove is formed between said second flat surface and said contiguous flat surface, said groove being formed by an extension of said second flat surface and a surface inclined towards said contiguous flat surface.

* * * * *